US007148162B2

(12) United States Patent
Park et al.

(10) Patent No.: US 7,148,162 B2
(45) Date of Patent: Dec. 12, 2006

(54) BALLISTIC LAMINATE STRUCTURE IN SHEET FORM

(76) Inventors: Andrew D. Park, 2851 E. Brigstock Rd., Midlothian, VA (US) 23113; Dave Park, 21102 Woodglen Ct., Walnut, CA (US) 91789; Alexander J. Park, 2851 E. Brigstock Rd., Midlothian, VA (US) 23113

( * ) Notice: Subject to any disclaimer, the term of this patent is extended or adjusted under 35 U.S.C. 154(b) by 147 days.

(21) Appl. No.: 10/796,662

(22) Filed: Mar. 8, 2004

(65) Prior Publication Data

US 2005/0197020 A1 Sep. 8, 2005

(51) Int. Cl.
*B32B 27/04* (2006.01)
*F41H 1/02* (2006.01)

(52) U.S. Cl. ..... 442/134; 442/50; 442/135; 428/911; 2/2.5; 89/36.01

(58) Field of Classification Search ..... 442/911, 442/50–58, 134, 135; 428/911; 2/2.5; 89/36.01, 89/36.02, 36.05
See application file for complete search history.

(56) References Cited

U.S. PATENT DOCUMENTS

| | | | | |
|---|---|---|---|---|
| 4,916,000 | A | | 4/1990 | Li et al. |
| 5,190,802 | A | | 3/1993 | Pilato et al. |
| 5,437,905 | A | | 8/1995 | Park et al. |
| 5,443,882 | A | | 8/1995 | Park |
| 5,443,883 | A | | 8/1995 | Park |
| 5,547,536 | A | | 8/1996 | Park |
| 5,635,288 | A | | 6/1997 | Park |
| 5,935,678 | A | * | 8/1999 | Park ..... 428/105 |
| 5,952,078 | A | | 9/1999 | Park |
| 6,651,543 | B1 | | 11/2003 | Park |

FOREIGN PATENT DOCUMENTS

| | | |
|---|---|---|
| GB | 2 319 988 A | 6/1998 |
| WO | WO 02/090866 A | 11/2002 |
| WO | WO 02/101319 A | 12/2002 |

OTHER PUBLICATIONS

"NonWoven Scrim Fabrics"; Scrimco, Inc.; p. 1; published prior to Mar. 8, 2004.

* cited by examiner

*Primary Examiner*—Arti Singh
(74) *Attorney, Agent, or Firm*—Schwartz Law Firm P.C.

(57) ABSTRACT

A ballistic laminate structure includes a first high-performance unifabric composite. The unifabric composite incorporates an array of unidirectionally-oriented fiber bundles carried on a fiber-stabilizing scrim and having a tensile strength greater than 7 grams per denier. A second high-performance unifabric composite includes an array of high performance, unidirectionally-oriented fiber bundles. The fiber bundles of the second composite are carried on a fiber-stabilizing scrim and have a tensile strength greater than 7 grams per denier. The first and second unifabric composites are cross-plied at an angle and bonded together to form the ballistic laminate structure.

10 Claims, 6 Drawing Sheets

BALLISTIC LAMINATE STRUCTURE IN SHEET FORM

TECHNICAL FIELD AND BACKGROUND OF THE INVENTION

This application relates to a ballistic laminate structure in sheet form, a ballistic panel constructed of a plurality of the sheets, a ballistic garment constructed of one or more of the ballistic panels, and a method of fabricating a ballistic laminate structure, and a ballistic resistant composite for hard-armor application.

Numerous ballistic laminates are known in the art including those described in Applicants own U.S. Pat. Nos. 5,437,905; 5,443,883; 5,547,536; 5,635,288; 5,935,678; and 5,952,078. The complete disclosure of each of these patents is incorporated herein by reference.

A ballistic non-woven laminate referred to commercially as SPECTRA SHIELD is manufactured by Honeywell, Inc. The laminate structure is used in soft body armor to protect the wearer against high-velocity bullets and fragments. SPECTRA SHIELD is made by first forming a non-woven unidirectional tape, composed of unidirectional polyethylene fibers and an elastic resin material that holds the fibers together. The resin penetrates to the filament level, impregnating the entire structure with the resin product. Two layers, or arrays, of the unidirectional tape are then laminated together (cross-plied) at right angles to form a panel. Then, the panel is covered on both sides with a thin film of polyethylene on the order of 0.001 inches thick. The film prevents adjacent panels from sticking together when the panels are layered together in the soft body armor.

Applicant's prior patents listed above describe a substantial improvement of this technology. Specifically, Applicant determined that ballistic laminates can be constructed of high performance fibers without using resins to hold the fibers together. This substantially reduces the weight of the structure without compromising the anti-ballistic characteristics of the structure. By omitting the resin, the cross-plied arrays of fibers directly contact each other, instead of being encapsulated and therefore separated from each other by the resin. An ultra-thin film is used both to cover the cross-plied arrays and to hold the arrays to each other. The prior art teaches that a critical limit of 80% fiber must be maintained in the laminate in order to maintain product integrity. If the percentage of resin, covers, and the like exceeds 20%, the anti-ballistic qualities of the laminate begin to degrade.

As a further improvement, Applicant recently discovered unexpected advantages in using a scrim to hold and stabilize the high performance fibers prior to lamination. The resulting laminate structure offers substantially enhanced ballistic performance. The scrim adds little weight to the final product, provides durable bonding and anti-fray performance, and is dry-clean resistant.

SUMMARY OF THE INVENTION

Therefore, it is an object of the invention to provide an improved ballistic laminate structure comprising unidirectionally-oriented high performance fibers stabilized using one or more nonwoven, adhesive scrims.

It is another object of the invention to provide an improved ballistic laminate structure which utilizes one or more fiber-stabilizing layers which little weight to the final product.

It is another object of the invention to provide an improved ballistic laminate structure which utilizes one or more fiber-stabilizing layers which provide durable bonding and anti-fray performance.

It is another object of the invention to provide an improved ballistic laminate structure which utilizes one or more fiber-stabilizing layers including adhesives that are dry-clean resistant.

It is another object of the invention to provide an improved ballistic laminate structure which utilizes one or more fiber-stabilizing scrims comprising multifilament yarns of polyester, nylon, glass, rayon and polypropylene.

It is another object of the invention to provide an improved ballistic laminate structure which utilizes one or more fiber-stabilizing scrims which are heat activated.

It is another object of the invention to provide an improved ballistic laminate structure which utilizes one or more fiber-stabilizing scrims having low basis weights.

It is another object of the invention to provide an improved ballistic laminate structure which utilizes one or more fiber-stabilizing scrims that provided enhanced weight to performance ratios, porosity, and bond strength to breathability ratios.

It is another object of the invention to provide an improved ballistic laminate structure which utilizes one or more fiber-stabilizing scrims having low weight to bond strength ratios.

It is another object of the invention to provide an improved high-performance unifabric composite.

It is another object of the invention to provide an improved protective garment.

These and other objects of the present invention are achieved in the preferred embodiments disclosed below by providing a ballistic laminate structure in sheet form. The laminate structure includes a first high-performance unifabric composite. The unifabric composite comprises an array of unidirectionally-oriented fiber bundles carried on a fiber-stabilizing scrim and having a tensile strength greater than 7 grams per denier. A second high-performance unifabric composite includes an array of high performance, unidirectionally-oriented fiber bundles. The fiber bundles of the second composite are carried on a fiber-stabilizing scrim and have a tensile strength greater than 7 grams per denier. The first and second unifabric composites are cross-plied at an angle and bonded together to form the ballistic laminate structure.

The term "scrim" is used broadly herein to refer to any loosely woven or nonwoven, open structure having a yarn density (yarns per inch in one direction) in the range of 5–20 per inch. The "high-performance unifabric composite" refers to a composite comprising fibers having a tensile strength greater than 7 grams per denier.

Preferably, the scrim is a nonwoven adhesive web.

According to another preferred embodiment of the invention, a polymeric film resides between the first and second cross-plied unifabric composites to adhere the composites together without substantial penetration of the film into the fiber bundles.

According to another preferred embodiment of the invention, the polymeric film is polyethylene film having a thickness of about 0.35 mils.

According to another preferred embodiment of the invention, the first unifabric composite is cross-plied at an angle of 90 degrees to the second unifabric composite.

According to another preferred embodiment of the invention, the percentage by weight of the high performance fibers in the ballistic laminate structure is at least 80 percent of the total weight of the ballistic laminate structure.

According to another preferred embodiment of the invention, the fiber bundles of the first and second unifabric composites comprise fibers chosen from the group consisting of aramid fiber, polyolefin, vinylon, and liquid crystal polymer-based fiber.

According to another preferred embodiment of the invention, the fiber bundles of the first and second unifabric composites comprise fibers chosen from the group consisting of extended chain ultra-high molecular weight polyethylene (UHMWPE), poly {p-phenylene-2,6-benzobisoxazole} (PBO), and poly {diimidazo pyridinylene (dihydroxy) phenylene} (M5).

According to another preferred embodiment of the invention, the first unifabric composite has a second fiber-stabilizing scrim located on an opposite side of the fiber bundles.

According to another preferred embodiment of the invention, the second unifabric composite has a second fiber-stabilizing scrim located on an opposite side of the fiber bundles.

In another embodiment, the invention is a ballistic laminate structure in sheet form including a first high-performance unifabric composite. The first composite includes an array of unidirectionally-oriented fiber bundles sandwiched between first and second fiber-stabilizing scrims. The fibers have a tensile strength greater than 7 grams per denier. A second high-performance unifabric composite includes an array of high performance, unidirectionally-oriented fiber bundles sandwiched between first and second fiber-stabilizing scrims. The fibers of this composite also have a tensile strength greater than 7 grams per denier. The first and second unifabric composites are cross-plied at an angle and bonded together to form the ballistic laminate structure.

In yet another embodiment, the invention is a high-performance unifabric composite adapted for incorporation in a sheet-form ballistic laminate structure. The unifabric composite includes an array of unidirectionally-oriented fiber bundles carried on a fiber-stabilizing scrim. The fibers of each bundle have a tensile strength greater than 7 grams per denier.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
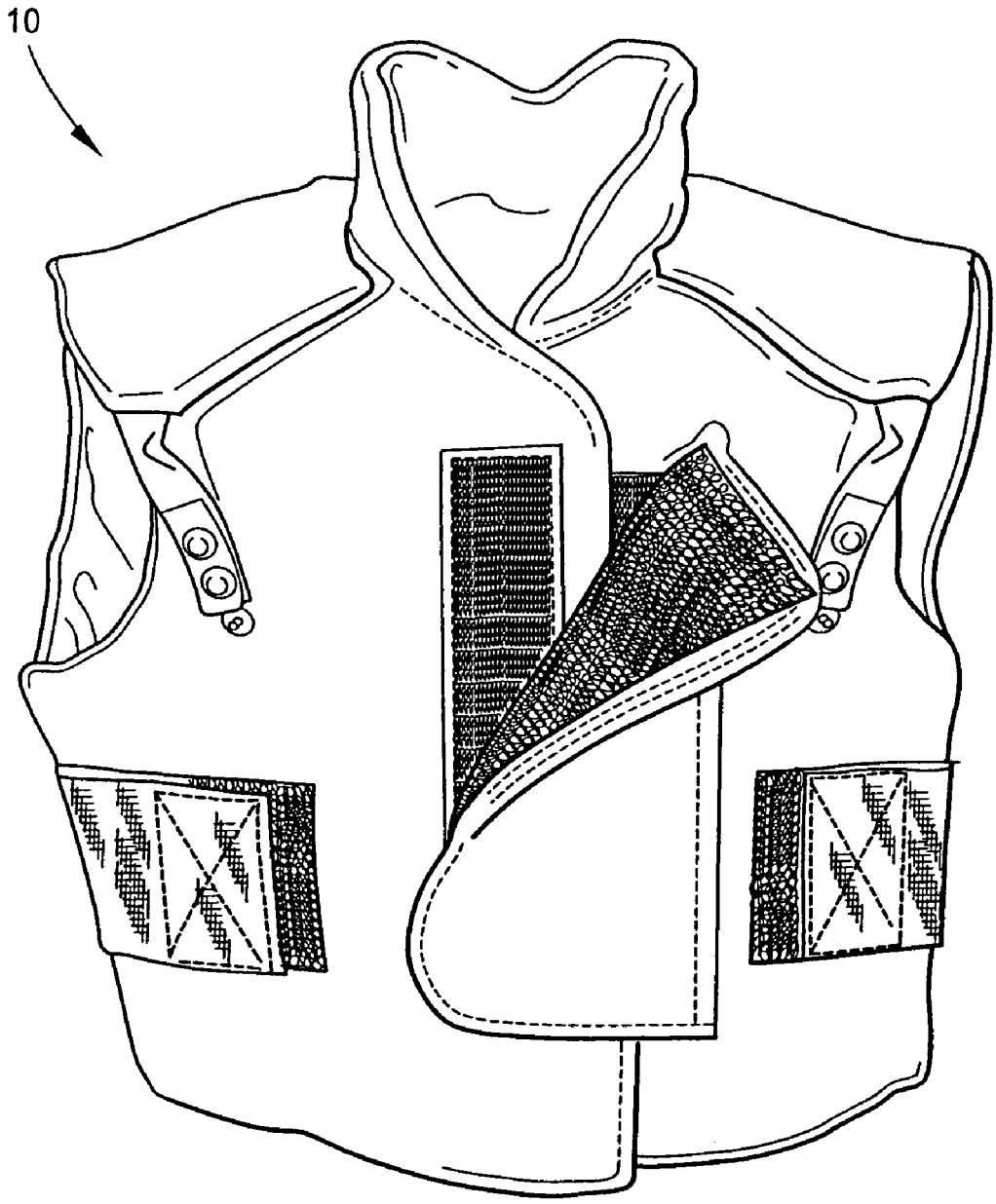
FIG. 1 is an armored body garment according to a preferred embodiment of the invention.

Referring now specifically to the drawings, a body-armor product according to the present invention is illustrated in FIG. 1 and shown generally at reference numeral 10. Although a ballistic vest 10 is shown, the principle of the invention is broadly applicable to any soft or hard armor product including other protective garments, panel inserts, helmets, windshields, vessels, tanks and other land vehicles, aircraft, and the like. The vest 10 is especially adapted for use by military personnel to protect the wearer against fragments and artillery fire.

Figure 2:
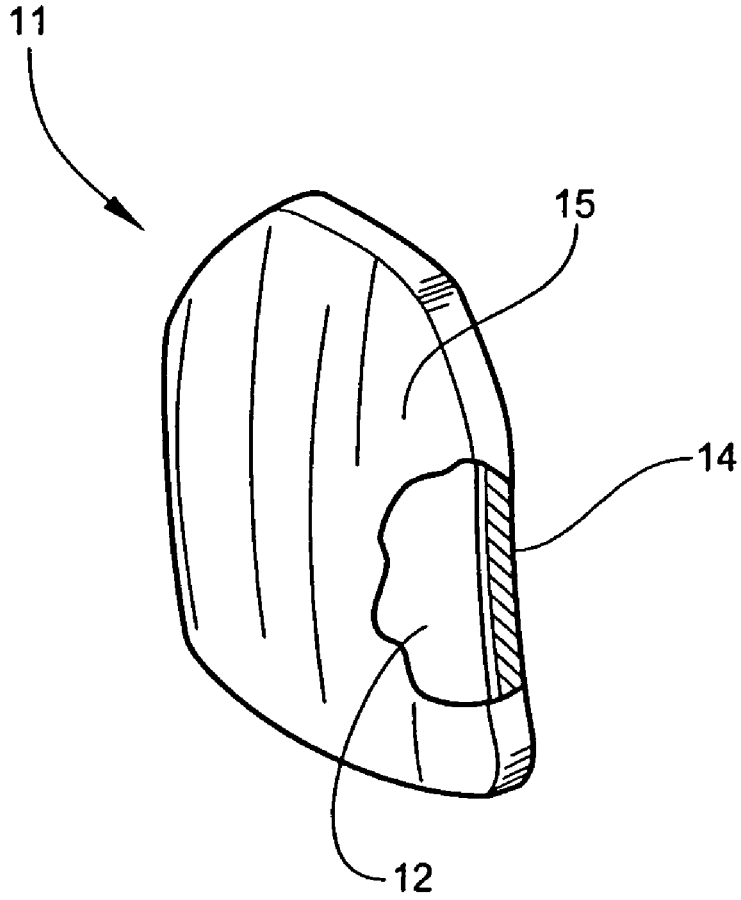
FIG. 2 is a perspective view of a ballistic panel insert incorporating a stacked arrangement of the present laminate structure.

The vest 10 incorporates a number of strategically arranged hard or soft-armor panel inserts 11, shown in FIG. 2. The inserts, referred to as "small arms protection inserts" (or SAPI's) comprise a rigid facing 12 and ballistic fabric backing 14 encased in an outer cover 15. The cover 15 may be formed of a single knit material, such as nylon fabric, or may be a rubberized coating formed by dipping, or may be a combination of fabric, rigid plastic, and foam or honeycomb structure that protects the plate from wear-and-tear, and which contains any fragmentation upon impact as appropriate.

The fabric backing 14 is constructed of multiple stacked layers of the ballistic laminate structure 20 illustrated in FIGS. 3 and 5, and described in further detail below. The stacked layers are laminated under heat and pressure to create a dense, rigid, unitary backing ranging in thickness from 0.130-inches to 0.350-inches. Lamination occurs via autoclave, press molding, a resin transfer mold, and/or an oven with vacuum pressure.

Ballistic Laminate Structure 20

Figure 3:
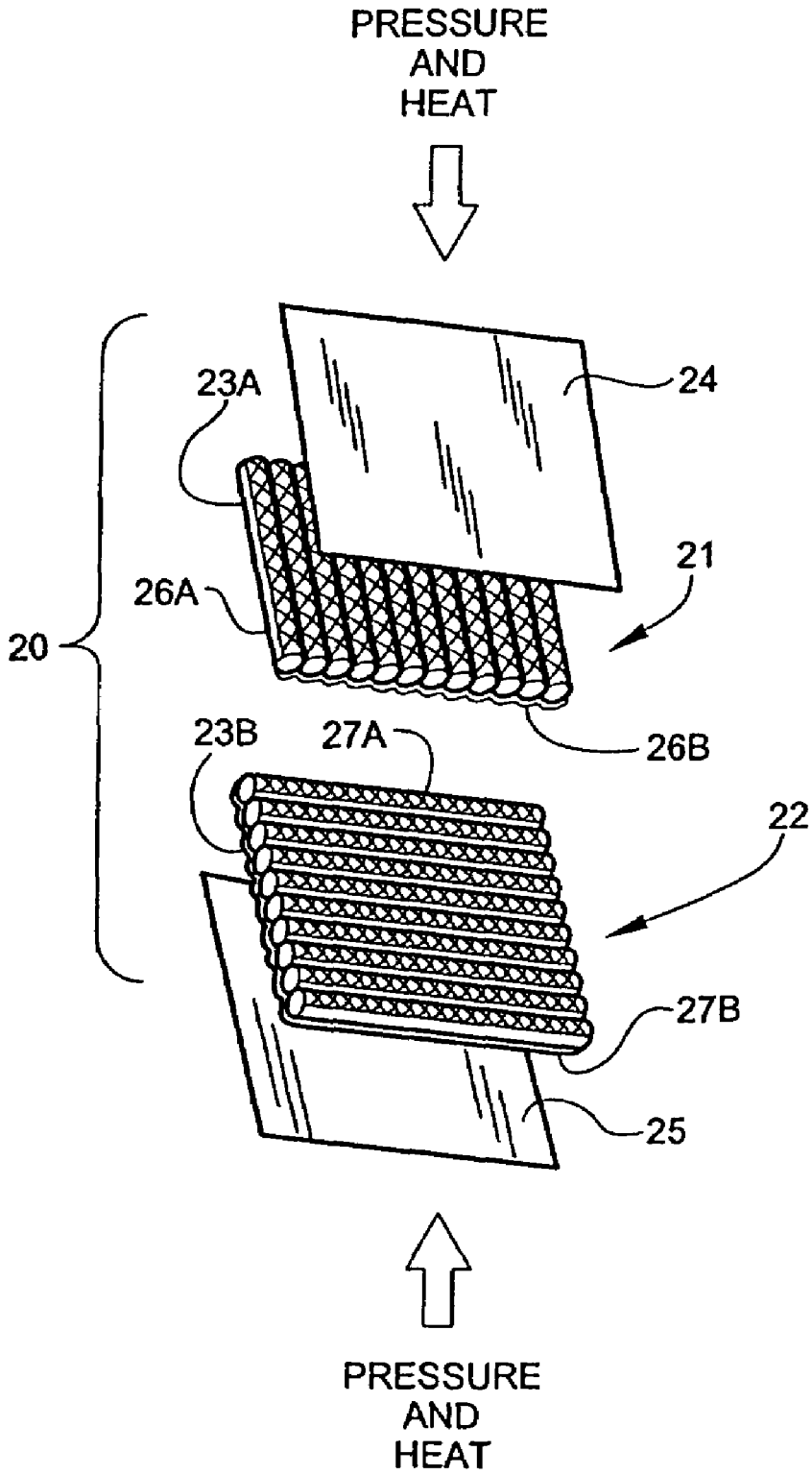
FIG. 3 illustrates formation of the ballistic laminate structure from two identical, cross-plied laminate composites.
Figure 4:
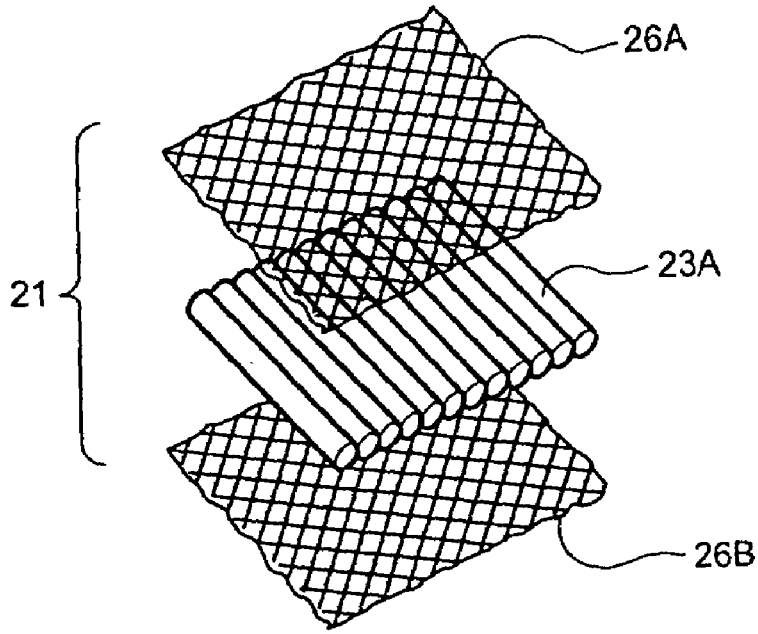
FIG. 4 illustrates formation of the laminate composite incorporated in the ballistic laminate structure.
Figure 5:
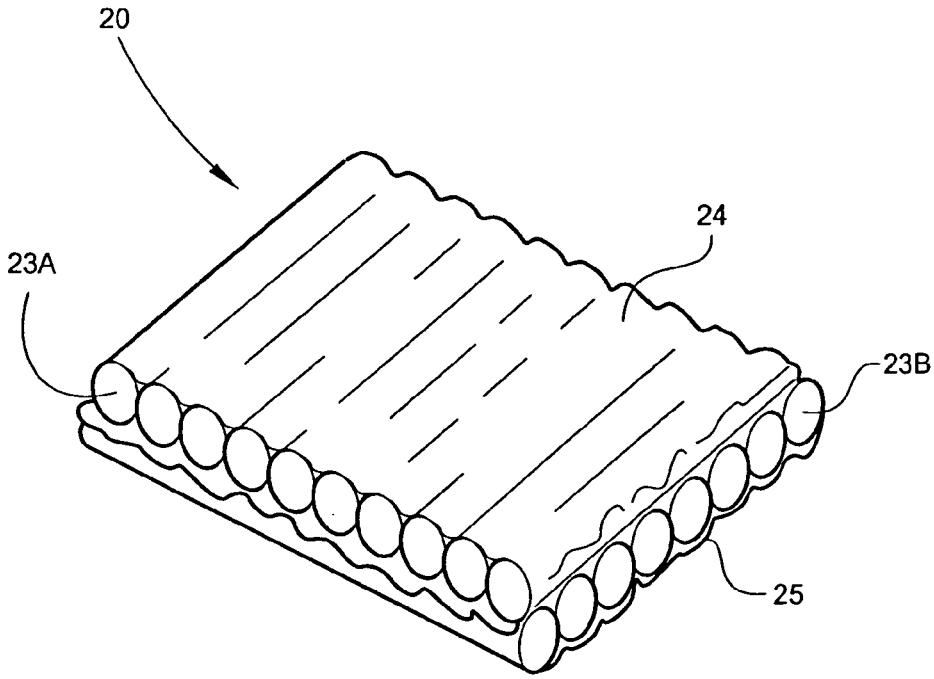
FIG. 5 is an enlarged, diagrammatic representation of the interaction of the thin covering films and the unidirectional fiber arrays of the laminate structure.

Referring to FIGS. 3, 4, and 5, the ballistic laminate structure 20 comprises multiple, high-performance, unifabric composites 21 and 22 stacked together in precise registration and coated on the outside with polyethylene film 24 and 25. A single composite 21 is best illustrated in FIG. 4. The composite 21 includes bundles 23A of untwisted, continuous-filament fibers sandwiched between respective fiber-stabilizing scrims 26A, 26B. The fibers are parallelized and formed into a unidirectionally-oriented array having a predetermined uniform number of bundles 23A per inch of width. The bundled fibers comprise any one or a combination of aramid, extended chain ultra-high molecular weight polyethylene (UHMWPE), poly {p-phenylene-2,6-benzobisoxazole} (PBO), and poly {diimidazo pyridinylene (dihydroxy) phenylene} (M5). Each of these fibers has a tensile strength greater than 7 grams per denier. Suitable commercial fibers include: Twaron® micro-denier fiber, Spectra Shield® PCR fiber, Dyneema® UD (unidirectional) fiber, PBO Zylon® fiber, and aramid Kevlar® fiber. The fibers are preferably HM (high modulus) grade with low moisture content. The preferred embodiment utilizes high-performance fibers having less than 5.4 dpf, and more preferably, less than 2.0 dpf, and most preferably, less than 1.5 dpf. The unifabric composite 22 is identical to the composite 21 described above and shown in FIG. 4.

Each scrim 26A, 26B and 27A, 27B is formed of a heat-activated, nonwoven, adhesive web, such as that manufactured and sold commercially by Spunfab of Cuyahoga Falls, Ohio. The adhesive web is based upon one or a combination of polyamide, polyester, elastomeric, urethane, and olefin polymers, and may be supplied in tape, sheet or roll form as a pre-measured, ready to use product. The web is cut to match the precise width and length of the fiber bundles 23A, 23B, and is loosely arranged over each opposing surface prior to activation of the adhesive. Once activated, the scrim 26A, 26B and 27A, 27B bonds to and further stabilizes the parallelized fiber bundles 23A, 23B. Thermal bonding may also be achieved through both heat activatable binder systems, such as Dow "Primacore", and thermoplastic bicomponent yarns. Heat is used to hold the scrim together initially, and to reactivate the scrim for bonding in subsequent lamination. Typical chemistries for the binders used to lock scrim yarns in place include polyvinyl alcohol, polyvinyl acetate, and butadiene styrene.

Referring again to FIG. 3, after application of the fiber-stabilizing scrims 26A, 26B and 27A, 27B, the unifabric composites 21, 22 are stacked in a cross-plied, 0/90-degree orientation such that the unidirectionally-oriented fiber bundles 23A of the first composite 21 extend substantially perpendicular to the unidirectionally-oriented fiber bundles 23B of the second composite 22. Other cross-ply angles are possible, such as 45 degrees. The stacked composites 21, 22 together with the outer films 24, 25 are then laminated under heat and pressure to create the ballistic laminate structure 20. The outer films 24, 25 may be applied to the composites 21, 22 either individually prior to lamination, or simultaneously during lamination.

The polyethylene films 24, 25 are extremely thin, on the order of about 0.25–1.0 mil and most preferably about 0.35 mil, so that the films will slightly coat the exterior surfaces of the individual fiber bundles 23A, 23B in each composite 21, 22, but will not penetrate into the fiber bundles 23A, 23B so as to coat and encapsulate the individual fibers and filaments. As indicated in FIG. 5, sufficient plasticized film material flows between the adjacent cross-plied arrays of fiber bundles 23A, 23B to bond the two composites 21, 22 together without use of additional adhesives or other bonding agents.

The percent ratio by weight of high performance fibers to film in the ballistic laminate structure 20 is preferably equal to or greater than 80:20. When the fiber weight drops below 80% of the overall weight of the laminate structure 20, the anti-ballistic qualities of the laminate structure 20 begin to degrade.

As best shown in FIG. 5, the fiber bundles 23A, 23B of each of the composites 21, 22 are at right angles to each other. Respective outer surfaces of the composites 21, 22 are coated with the films 24, 25. As is illustrated, the film 24, 25 has melted and flowed into the interstices between the fiber bundles 23A, 23B of each of the composites 21, 22. Sufficient melted polyethylene from both of the films 24, 25 have intermingled with each other and coated the outer surface of the fiber bundles 23A, 23B of the other composite to create a surface bond to hold the two composites 21, 22 together to form the ballistic laminate structure 20.

Figure 6:
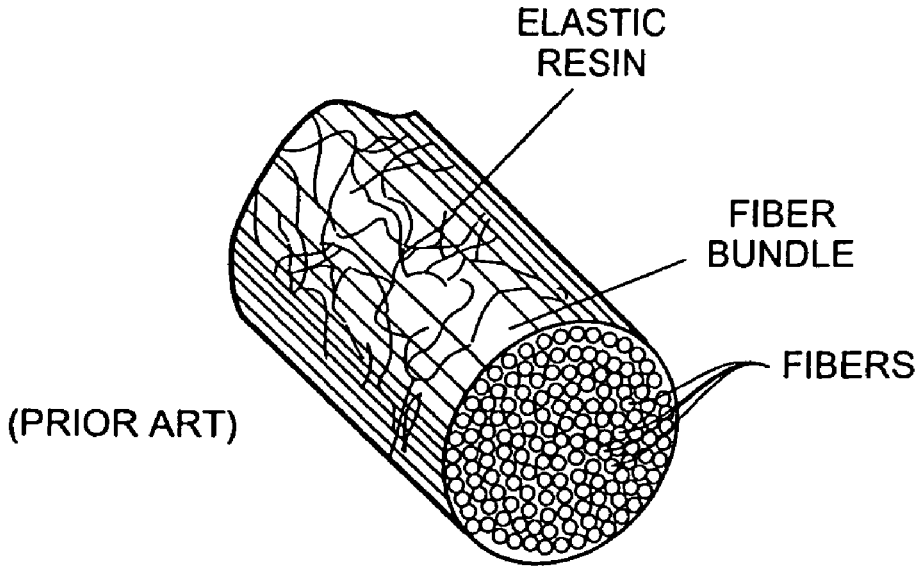
FIG. 6 is an enlarged view of a single fiber bundle according to the prior art, showing complete impregnation of the resin into the structure of the fiber bundle.
Figure 7:
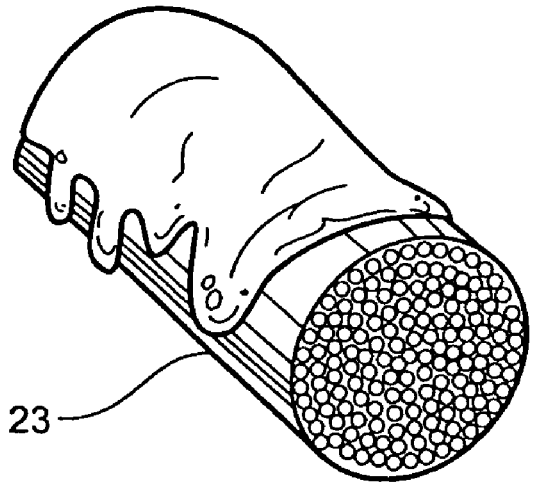
FIG. 7 is a enlarged view of a single fiber bundle according to an embodiment of the invention showing lack of impregnation of the resin into the structure of the fiber bundle.

This is illustrated more clearly in FIGS. 6 and 7. FIG. 6 shows a prior art construction such as a SPECTRA SHIELD product using both an elastic resin and a surface film. The individual fiber bundles and the individual fibers which make up the bundle are substantially completely encapsulated with the elastic resin (the black, surrounding material) as well as the outside of the fiber bundle. This adds to the weight of the product and creates the possibility of variation in quality if too much or too little resin is used, or if the resin is applied unevenly or inconsistently.

In contrast, the fiber bundles 23A according to the present invention are coated by the film 24 on the outside surface only, so that the integral structure of parallel, closely bunched filaments and fibers remains intact, and intimate contact between the closely bunched filaments and fibers remains. The film may not even coat the entire outer surface of the fiber bundle, but only to a sufficient degree to properly bond the two composites 21, 22 together to form the laminate structure 20. Film 25 coats the fiber bundles 23B in an identical manner.

Although the films 24, 25 of the laminate structure 20 are preferably formed of polyethylene, other polymeric materials such as thermosetting plastics, thermoplastics, or elastomerics may be used. In the case of thermosetting plastics, the film is not fully cured prior to formation of the laminate structure. The amount of heat and pressure required during lamination is a function of the duration of the lamination process, and the thickness and other properties of the film being used.

Figure 8:
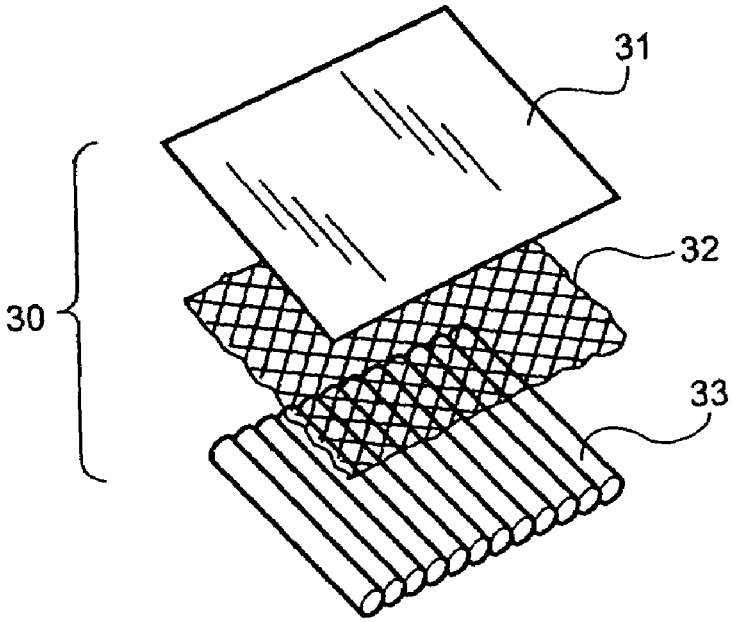
FIG. 8 illustrates formation of a laminate composite according to a further preferred embodiment of the invention.

A second embodiment of a high-performance, unifabric composite 30 according to present invention is shown in FIG. 8. The unifabric composite 30 comprises an outer polyethylene film layer 31, a fiber-stabilizing scrim 32, and a unidirectionally-oriented array of high-tenacity fiber bundles 33, as described above. The layers 31, 32, and 33 are stacked in precise registration and laminated under heat and pressure to form the unifabric composite 30. The film-coated composite 30 is then cross-plied with a like composite (not shown) and laminated to form a further ballistic laminate structure according to the present invention.

In yet another embodiment, a film-coated unifabric composite may be cross-plied and laminated with a composite that does not include a film coating. In this case, the plasticized film flowing from the coated array of fiber bundles to the uncoated array of fiber bundles is sufficient to bond the two sheet composites together to form a modified ballistic laminate structure. Alternatively, the laminate structure may be formed by sandwiching a film layer between two uncoated sheet composites of high-performance fibers, or between two coated composites of high performance fibers.

One preferred embodiment of the ballistic laminate structure is given in the following example:

Fiber—aramid

Fiber construction—840 denier, less than 1.5 den/fil. per tow.

Scrim—2 layers of polyethylene-based, nonwoven, adhesive web/unifabric

Laminate Construction—nominal 20–21 ends/inch unidirectional untwisted tows

Number of unifabric composites in laminate structure—2 plies

Sheet orientation of 1st and 2nd laminate structures—90 degrees

Film—0.35 mil polyethylene

Laminate structure—intimately plied sheets with overlying, surface-applied polyethylene film Percentage of fiber weight to film weight—80%

For added fiber stability, one or more fill fibers may be woven or stitched into the arrayed fiber bundles prior to forming the ballistic laminate structure in order to maintain the unidirectional orientation and structural integrity of the fibers during handling and lamination. The fill fibers may be any commercially available fiber which may or may not be a high performance fiber. The fill fibers may be monofilament, multi-filament, bi-component filament, ribbon, or strips.

Ballistics Testing

In the ballistics industry, performance is generally determined based on V50 ballistic test limits for impacts on an 18"×18" test cloth. The test cloth is formed of multiple overlying plies of ballistic fabric. The V50 ballistic test limit is the average of 10 fair impact velocities consisting of the five lowest complete penetration velocities and five highest partial penetration velocities provided that the spread for the 10 velocities is not greater than an allowable range of 150 feet per second (fps). If the 10-round average cannot be attained within the allowable range, the ballistic cloth is retested. The V50 ballistic limit is determined for a given-size steel fragment by averaging the V50 test results for three test cloths.

A cloth sample of the present ballistic laminate structure (Sample A) was tested and compared against a similar laminate structure (Sample B). "Sample A" was constructed, as described above, using scrims on each side of the unidirectionally-oriented fiber bundles. "Sample B" was constructed in an identical manner using the same fibers, but without the use of scrims to further stabilize the fiber bundles. Each sample was nominal 18×18 inches, and included 30 overlying plies of the particular laminate structure.

Testing was conducted in accordance with the V50 provisions of NIJ-STD-0101.04, using caliber 9 mm Luger, 124 grain, FMJ ammunition. The test samples were mounted on an indoor range 16.4 feet from the muzzle of a test barrel to produce zero degree obliquity impacts. Photoelectric lumiline screens were positioned at 6.5 feet and 11.5 feet which, in conjunction with elapsed time counters (chronographs), were used to determine projectile velocities 9.0 feet from the muzzle. Table 1 is a summary of the attached data records.

TABLE 1

SUMMARY OF RESULTS

| Test Sample | | Ballistic Threat | | Ballistic Limit (fps) | | |
|---|---|---|---|---|---|---|
| Number | Weight (lb) | Caliber | Total Shots/V50 | V50 BL(P) | High Partial | Low Complete |
| Sample A | 2.41* | 9 mm | 12/10 | 1821 | 1818 | 1805 |
| Sample B | 1.93* | 9 mm | 11/10 | 1668 | 1695 | 1641 |

*Dry fabric weight for each of Sample A and B was equal.

As shown above, the "Sample A" test cloth incorporating the present ballistic laminate structure offered superior ballistic performance, as compared to "Sample B" which omitted the scrims.

A high-performance unifabric composite, ballistic laminate structure incorporating cross-plied unifabric composites, ballistic panel insert incorporating multiple ballistic laminate structures, and a garment including one or more ballistic panel inserts are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A ballistic laminate structure in sheet form, comprising:

(a) a first high-performance unifabric composite including an array of unidirectionally-oriented fiber bundles carried on a first fiber-stabilizing scrim and said bundles comprising fibers having a tensile strength greater than 7 grams per denier, and said first scrim comprising a heat-activated fibrous web;

(b) a second high-performance unifabric composite cross-plied at an angle to said first unifabric composite, said second unifabric composite including an array of high performance, unidirectionally-oriented fiber bundles carried on a second fiber-stabilizing scrim and said bundles comprising fibers having a tensile strength greater than 7 grams per denier, and said second scrim comprising a heat-activated fibrous web; and (c) whereby said first and second unifabric composites are thermally-bonded together upon heat activation of said first and second scrims to form said ballistic laminate structure.

2. A ballistic laminate structure according to claim 1, and comprising a polymeric film residing between said first and second cross-plied unifabric composites to adhere said composites together without substantial penetration of said film into said fiber bundles.

3. A ballistic laminate structure according to claim 1, wherein said polymeric film comprises polyethylene film having a thickness of about 0.35 mils.

4. A ballistic laminate structure according to claim 1, wherein said first unifabric composite is cross-plied at an angle of 90 degrees to said second unifabric composite.

5. A ballistic laminate structure according to claim 1, wherein the percentage by weight of the high performance fibers in the ballistic laminate structure is at least 80 percent of the total weight of the ballistic laminate structure.

6. A ballistic laminate structure according to claim 1, wherein the fiber bundles of said first and second unifabric composites comprise fibers chosen from the group consisting of aramid fiber, polyolefin, vinylon, and liquid crystal polymer-based fiber.

7. A ballistic laminate structure according to claim 1, wherein the fiber bundles of said first and second unifabric composites comprise fibers chosen from the group consisting of extended chain ultra-high molecular weight polyethylene (UHMWPE), poly {p-phenylene-2, 6-benzobisoxazole} (PBO), and poly {diimidazo pyridinylene (dihydroxy) phenylene} (M5).

8. A ballistic laminate structure according to claim 1, wherein said first unifabric composite comprises a second scrim located on an opposite side of said fiber bundles.

9. A ballistic laminate structure according to claim 1, wherein said second unifabric composite comprises a second scrim located on an opposite side of said fiber bundles.

10. A ballistic laminate structure in sheet form, comprising:

(a) a first high-performance unifabric composite including an array of unidirectionally-oriented fiber bundles sandwiched between first and second fiber-stabilizing scrims, and said bundles comprising fibers having a tensile strength greater than 7 grams per denier, each of said first and second scrims of said first composite comprising a heat-activated fibrous web;

(b) a second high-performance unifabric composite including an array of high performance, unidirectionally-oriented fiber bundles sandwiched between first and second scrims, and said bundles comprising fibers having a tensile strength greater than 7 grams per denier, each of said first and second scrims of said second composite comprising a heat-activated fibrous web; and (c) whereby said first and second unifabric composites are thermally-bonded together upon heat activation of said scrims to form said ballistic laminate structure.

* * * * *